US006024777A

United States Patent [19]

Houser et al.

[11] Patent Number: 6,024,777

[45] Date of Patent: Feb. 15, 2000

[54] COMPACTED STEEL POWDER ALLOYING ADDITIVE FOR ALUMINUM MELTS, METHOD OF MAKING AND METHOD OF USING

[75] Inventors: Stephen L. Houser, Vienna, W. Va.; Timothy Chimera, Coraopolis, Pa.

[73] Assignee: Eramet Marietta Inc., Marietta, Ohio

[21] Appl. No.: 09/042,873

[22] Filed: Mar. 17, 1998

[51] Int. Cl.[7] ..... C22B 21/06

[52] U.S. Cl. ..... 75/304; 75/316; 75/684; 75/770; 75/950; 419/69

[58] Field of Search ..... 75/304, 316, 684, 75/770, 950; 419/69

[56] References Cited

U.S. PATENT DOCUMENTS

| | | | |
|---|---|---|---|
| 3,865,577 | 2/1975 | Gottschol et al. | 75/304 |
| 3,935,004 | 1/1976 | Faunce | 75/68 R |
| 5,766,544 | 6/1998 | Kemp | 266/173 |

FOREIGN PATENT DOCUMENTS

| | | |
|---|---|---|
| 0066207 | 12/1982 | European Pat. Off. . |
| 0260930 | 3/1988 | European Pat. Off. . |
| 744239 | 1/1944 | Germany . |
| 2299099 | 9/1996 | United Kingdom . |
| WO9417217 | 8/1994 | WIPO . |
| WO9822630 | 5/1998 | WIPO . |

OTHER PUBLICATIONS

Treatise on Powder Metallurgy—Goetzel, vol. II, Applied and Physical Powder Metallurgy, 1950—pgs. 272–273, pp. 305–306, pp. 312–321, 1950.

*Primary Examiner*—Melvyn Andrews
*Attorney, Agent, or Firm*—Bierman, Muserlian and Lucas

[57] ABSTRACT

A compacted steel powder in particulate form is used as an alloying additive for aluminum melts. The additive is in the form of a wafer which is smooth on one side and corrugated on the other side such that its thickness is 1 mm at the trough and 2–3 mm at the peak. The shape of the additive results in dissolution of the additive in the aluminum melts at an equivalent rate as compared to a conventional briquette.

20 Claims, 1 Drawing Sheet

COMPACTED STEEL POWDER ALLOYING ADDITIVE FOR ALUMINUM MELTS, METHOD OF MAKING AND METHOD OF USING

BACKGROUND OF THE INVENTION

1. Field of Invention

This invention relates to alloying additives for aluminum melts and, more particularly, to a compacted, substantially pure iron product for aluminum melts.

2. Prior Art

Iron is added to aluminum melts as an essential element for thin-gauged wrought aluminum products. Typically, such iron additives take the form of iron-aluminum briquettes which comprise, for example, 70–80% iron with a remainder of aluminum. Often, a binder, such as a resin or a wax, is used to hold the briquette together.

SUMMARY OF THE INVENTION

It has now been discovered that an additive which comprises a compacted, substantially pure iron product in particulate form can be used as an alloying additive for aluminum melts. The additive of the present invention is preferably substantially free and, more preferably, completely free of any binder. The iron product used to make the additive of the present invention is an iron powder that is substantially pure, 99% iron. The preferred iron product is an atomized, steel powder. The particulate form is preferably a wafer which is smooth on one side and corrugated on the other side. It has been found that the additive of the present invention dissolves at least as rapidly in the aluminum melt than conventional briquettes but costs less to produce. The dissolution of the wafer in the aluminum melt is attributed to the shape, thickness and density of the wafer, and is especially due to the presence of the corrugated side of the wafer.

DETAILED DESCRIPTION OF THE INVENTION

Preferably, the compacted, substantially pure, iron product comprises about 99% iron, and is substantially free of refractive oxides and trace elements that impart unwanted physical and chemical characteristics of the aluminum. More preferably, the iron product is a steel which is about 99% iron. Preferably the iron product is in the form of a powder. Good results have been obtained with an atomized steel powder. Preferably, the steel powder used to make the compacted additive has the following chemical analysis:

| Element | Percent By Weight (%) |
|---|---|
| Iron (Fe) | 99 (minimum) |
| Manganese (Mn) | 0.3 |
| Chrome (Cr) | 0.1 |
| Silicon (Si) | 0.05 |
| Copper (Cu) | 0.1 |

-continued

| Element | Percent By Weight (%) |
|---|---|
| Nickel (Ni) | 0.1 |
| Vanadium (V) | 0.05 |
| Lead (Pb) | 0.001 |
| Cadmium (Cd) | 0.001 |
| Carbon (C) | 0.05 |

Atomized steel powders are conventional and readily available in the marketplace. Atomized steel powders are typically made by an atomizing process where the molten steel is rapidly cooled in a powdered form.

Suitable powder used in the present invention has a particle sieve size between about 30 and about 200. More preferably, the particle size is such that about 80% of the material has a sieve size between about 60 and about 140. Suitably, the loose powder has an apparent density of about 3 g/cc.

In order to make the additive of the present invention, the powder is compacted into a sheet and then the sheet is broken into a particulate form.

Figure 1:
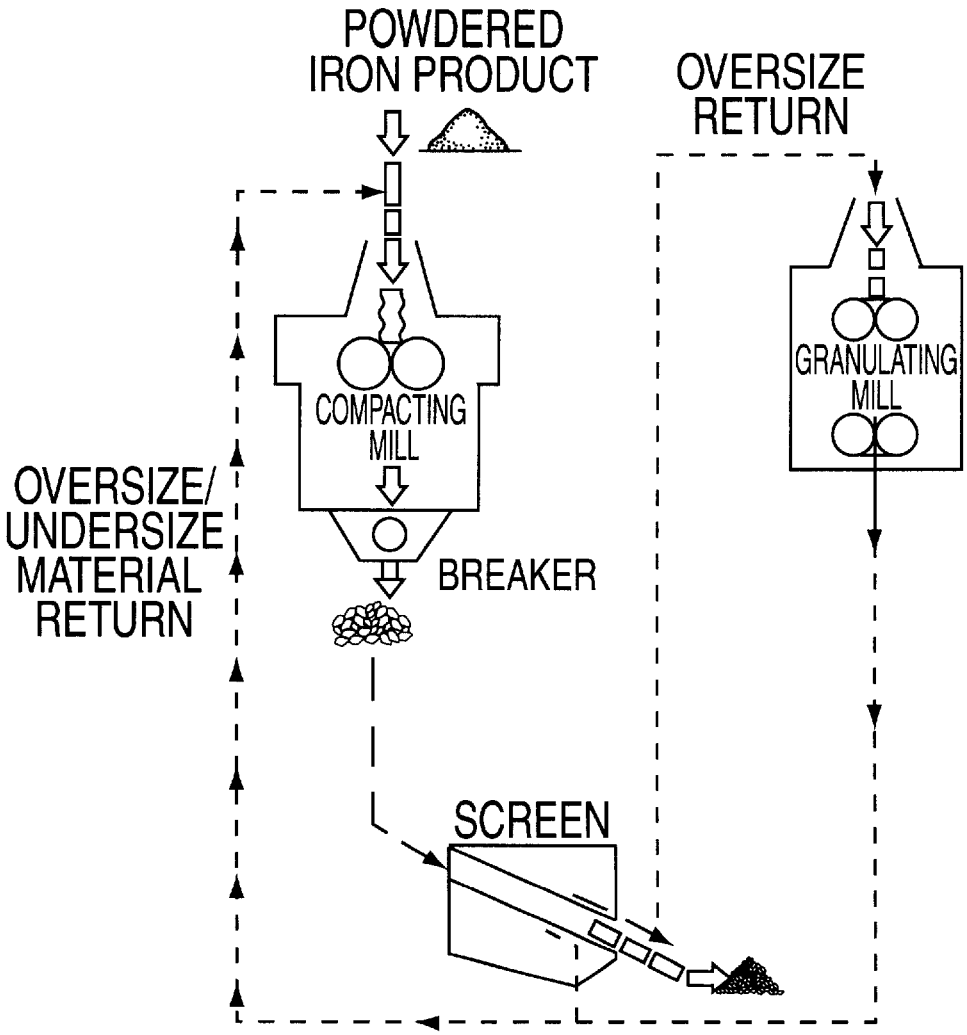
FIG. 1 illustrates a compacting mill and material breaker used to make the additive of the present invention.

FIG. 1 illustrates a process for making the additive of the present invention. Substantially pure powdered iron product is compacted in a compacting mill using a roll press (press roll compactor). The powder is fed into the gap between two rolls which are typically rotated at equal speeds. The feed to the roll press is substantially free and, more preferably, completely free of a binder. The size and the shape of the additive is determined by the geometry of the surfaces of the rolls. In accordance with the present invention, one roll has a smooth surface while the other roll has a corrugated surface. The output from the rolls is a sheet having one smooth side and one corrugated side. The corrugated side has troughs and peaks.

From the roll press the compacted sheet is fed to a material breaker which breaks the sheet into flakes or wafers. The product is then screened to divide the output from the material breaker by size. Oversized material is then fed to a granulator mill to break it into a feed material for the compacting mill. The oversize and undersized material are then recycled to the roll press. Proper sized material is bagged for use and sale.

A lubricator can be used with the roll press, if necessary, however, a dryer should then be employed on the compacted material to dry the material. It is preferred that the additive of the present invention comprise about 99% by weight iron, thereby avoiding the introduction of unwanted contaminates to the aluminum melt.

Press rolls and material breakers are conventional pieces of equipment which are operated in a conventional manner in order to make the additive of the present invention. As can be appreciated, the additive of the present invention is not sintered.

The amount of pressure necessary to form the compacted additive of the present invention will vary depending on the type of powder and the type of roll press. It has been found that the compacted material is strong enough and has enough mechanical integrity to withstand handling and transportation.

Preferably, the shape of the particulate additive of the present invention is a flake or a wafer. The preferred dimensions, length and width, of the wafer are about 2.5 cm by about 2.5 cm with a thickness of about 1 mm to about 3 mm. More preferably, the wafer has one smooth side and one corrugated side such that the thickness of the wafer at its trough is about 1 mm and the thickness at its ridge is about 2 mm to about 3 mm.

Figure 2:
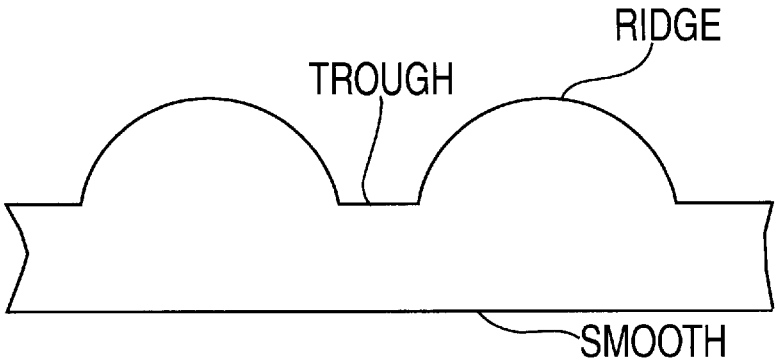
FIG. 2 illustrates the cross-section of the additive of the present invention.

FIG. 2 illustrates a cross-section of the additive of the present invention with its smooth side and corrugated side. The corrugated side has troughs and ridges as shown.

The density of the particulate additive of the present invention is about 8 g/cc to about 3 g/cc and, more preferably, about 7 g/cc to about 4 g/cc. Good results have been obtained with a density of about 5 g/cc. These are specified densities.

It has been found that the additive of the present invention dissolves completely in an aluminum melt in about 10 minutes and that in about 5 minutes at least 50% has been dissolved.

The additive of the present invention is added to an aluminum melt as an iron alloying components, especially suited for thin gauge wrought aluminum products. The method of addition of the additive of the present invention is accomplished in a conventional manner using conventional equipment.

It will be understood that the claims are intended to cover all changes and modifications of the preferred embodiments of the invention herein chosen for the purpose of illustration which do not constitute a departure from the spirit and scope of the invention.

What is claimed is:

1. An additive for aluminum melts comprising a compacted atomized steel powder completely free of a binder in particulate form, said steel powder having an iron content of greater than or equal to about 99%, said particulate form being a wafer wherein one side of said wafer is smooth and the other side of said wafer is corrugated with ridges and troughs, said wafer having a density of about 8 g/cc to about 3 g/cc and a thickness of about 1 to about 3 mm.

2. The additive of claim 1 wherein said wafer has a thickness of about 1 mm at said troughs and a thickness of about 2 to about 3 mm at said ridges.

3. The additive of claim 1 wherein said wafer has a length and a width of about 2.5 cm by about 2.5 cm.

4. The additive of claim 1 wherein said wafer has a density of about 7 g/cc to about 4 g/cc.

5. The additive of claim 1 wherein said steel powder has a particle sieve size, before compacting, between about 30 to about 200.

6. The additive of claim 1 wherein said wafer has a density of about 5 g/cc.

7. The additive of claim 1 wherein said wafer has a density of about 7 g/cc to about 4 g/cc, a thickness of about 1 mm at said troughs and a thickness of about 2 to about 3 mm at said ridges, and a length and width of about 2.5 cm by about 2.5 cm.

8. The additive of claim 7 wherein said steel powder has a particle sieve size, before compacting, between about 30 to about 200 and said wafer has a density of about 5 g/cc.

9. A method for forming an additive for use in an aluminum melt comprising:

feeding an atomized steel powder having an iron content of greater than or equal to about 99% without a binder to a roll press wherein one roller is smooth and the other roller is corrugated with ridges and troughs to obtain a sheet of compacted atomized steel powder having a density of about 8 g/cc to about 3 g/cc wherein one side of said sheet is flat and the other side of said sheet is corrugated with ridges and troughs and a thickness of about 1 to about 3 mm; and feeding said sheet to a material breaker to break the sheet into wafers.

10. The method of claim 9 wherein said sheet is broken by said material breakers into a wafer having a length and width of about 2.5 cm by 2.5 cm.

11. The method of claim 9 wherein said density of said sheet is about 7 g/cc to about 4 g/cc.

12. The method of claim 9 wherein said density of said sheet is about 5 g/cc.

13. The method of claim 9 wherein said atomized steel powder has a particle sieve size between about 30 to about 200.

14. The method of claim 9 wherein said sheet has a thickness of about 1 mm at said troughs and about 2 mm to about 3 mm at said ridges.

15. The method of claim 9 wherein said atomized steel powder has a particle sieve size between about 30 to about 200, said sheet of compacted atomized steel powder has a density of about 5 g/cc, said sheet having a thickness of about 1 mm at said troughs and about 2 mm to about 3 mm at said ridges, and said wafers have a length and a width of about 2.5 cm by about 2.5 cm.

16. A method for adding an iron alloying additive to an aluminum melt comprising:

dissolving in an aluminum melt a compacted atomized steel powder completely free of a binder in particulate form, said steel powder having an iron content of greater than or equal to about 99%, said particulate form being a wafer wherein one side of said wafer is smooth and the other side of said wafer is corrugated with ridges and troughs, said wafer having a density of about 8 g/cc to about 3 g/cc and a thickness of about 1 to about 3 mm such that said wafer dissolves completely in said aluminum melt in about ten minutes.

17. The method of claim 16 wherein said wafer has a thickness of about 1 mm at said troughs and a thickness of about 2 to about 3 mm at said ridges.

18. The method of claim 16 wherein said wafer has a length and a width of about 2.5 cm by about 2.5 cm.

19. The method of claim 16 wherein said steel powder has a particle sieve size, before compacting, between about 30 to about 200.

20. The method of claim 16 wherein said wafer has a density of about 7 g/cc to about 4 g/cc, a thickness of about 1 mm at said troughs and a thickness of about 2 to about 3 mm at said ridges, and a length and width of about 2.5 cm by about 2.5 cm.

* * * * *